US011059094B2

(12) United States Patent
Ren et al.

(10) Patent No.: US 11,059,094 B2
(45) Date of Patent: Jul. 13, 2021

(54) METHOD AND DEVICE FOR PREPARING SEMI-SOLID SLURRY

(71) Applicant: ZHUHAI RUNXINGTAI ELECTRICAL CO., LTD., Zhuhai (CN)

(72) Inventors: Huaide Ren, Zhuhai (CN); Ying Zhang, Zhuhai (CN); Jicheng Wang, Zhuhai (CN); Gunan Li, Zhuhai (CN)

(73) Assignee: ZHUHAI RUNXINGTAI ELECTRICAL CO., LTD., Zhuhai (CN)

( * ) Notice: Subject to any disclaimer, the term of this patent is extended or adjusted under 35 U.S.C. 154(b) by 359 days.

(21) Appl. No.: 15/874,861

(22) Filed: Jan. 18, 2018

(65) Prior Publication Data

US 2018/0141112 A1 May 24, 2018

Related U.S. Application Data

(63) Continuation-in-part of application No. PCT/CN2016/105099, filed on Nov. 8, 2016.

(30) Foreign Application Priority Data

Dec. 2, 2015 (CN) ..... 201510873950.X

(51) Int. Cl.
*B22D 1/00* (2006.01)
*B01F 15/06* (2006.01)
(Continued)

(52) U.S. Cl.
CPC ..... *B22D 1/00* (2013.01); *B01F 7/007* (2013.01); *B01F 7/00041* (2013.01);
(Continued)

(58) Field of Classification Search
None
See application file for complete search history.

(56) References Cited

U.S. PATENT DOCUMENTS 3,156,452 A 11/1964 Touzalin et al.
3,951,651 A 4/1976 Mehrabian et al.
(Continued)

FOREIGN PATENT DOCUMENTS

CN 101745629 A 6/2010
CN 102345023 A 2/2012
(Continued)

OTHER PUBLICATIONS

Espacenet machine translation of CN 104988343 retrieved on Mar. 12, 2020 (Year: 2015).*
(Continued)

*Primary Examiner* — Keith D. Hendricks
*Assistant Examiner* — Joshua S Carpenter
(74) *Attorney, Agent, or Firm* — Anova Law Group, PLLC

(57) ABSTRACT

A method for preparing semisolid slurry. The method is achieved using a device for preparing semisolid slurry. The device includes a slurry vessel and a mechanical stirring rod. The mechanical stirring rod includes a first end and a second end extending into the slurry vessel. The method includes: S1. putting a molten alloy having a first preset temperature into the slurry vessel; S2. cooling the molten alloy to a second preset temperature, positioning the second end of the mechanical stirring rod to be 5-25 mm higher than the bottom wall of the slurry vessel, rotating the mechanical stirring rod and injecting a cooling medium into the mechanical stirring rod; and S3: allowing the temperature of the molten alloy to be 10-90 degrees centigrade lower than
(Continued)

the liquidus temperature of the molten alloy, stopping stirring and cooling, to yield a semisolid slurry.

4 Claims, 2 Drawing Sheets

(51) Int. Cl.

| | |
|---|---|
| ***B22D 21/04*** | (2006.01) |
| ***B01F 7/18*** | (2006.01) |
| ***B01F 7/00*** | (2006.01) |
| ***B01F 15/00*** | (2006.01) |
| ***B22D 17/00*** | (2006.01) |

(52) U.S. Cl.
CPC ..... *B01F 7/00291* (2013.01); *B01F 7/00716* (2013.01); *B01F 7/18* (2013.01); *B01F 15/00175* (2013.01); *B01F 15/00396* (2013.01); *B01F 15/066* (2013.01); *B01F 15/068* (2013.01); *B22D 17/007* (2013.01); *B22D 21/04* (2013.01); *B01F 15/063* (2013.01); *B01F 2015/061* (2013.01); *B01F 2215/0044* (2013.01)

(56) References Cited

U.S. PATENT DOCUMENTS

| | | | | |
|---|---|---|---|---|
| 6,241,001 | B1 | 6/2001 | Kono | |
| 2002/0096231 | A1* | 7/2002 | Flemings | C22B 9/003 148/538 |

FOREIGN PATENT DOCUMENTS

| | | | | |
|---|---|---|---|---|
| CN | 102409187 | A | | 4/2012 |
| CN | 102620575 | A | | 8/2012 |
| CN | 102345023 | B | * | 3/2013 |
| CN | 103008603 | A | | 4/2013 |
| CN | 103658608 | A | | 3/2014 |
| CN | 104232953 | A | | 12/2014 |
| CN | 104988343 | A | * | 10/2015 |
| CN | 104988343 | A | | 10/2015 |
| CN | 105328143 | A | | 2/2016 |
| EP | 0761344 | B1 | | 12/2003 |
| JP | H11005142 | A | | 1/1999 |
| JP | 2005297003 | A | | 10/2005 |

OTHER PUBLICATIONS

Espacenet machine translation of 102345023 retrieved on Mar. 12, 2020 (Year: 2013).*

* cited by examiner

METHOD AND DEVICE FOR PREPARING SEMI-SOLID SLURRY

CROSS-REFERENCE TO RELATED APPLICATIONS

This application is a continuation-in-part of International Patent Application No. PCT/CN2016/105099 with an international filing date of Nov. 8, 2016, designating the United States, which claims priority to Chinese Patent Application No. 201510873950.X filed Dec. 2, 2015. The contents of both of the aforementioned applications, including any intervening amendments thereto, are incorporated herein by reference.

BACKGROUND OF THE INVENTION

Field of the Invention

The disclosure relates to a method and device for preparing semisolid slurry.

Description of the Related Art

Existing methods for preparing semisolid slurry include mechanical stirring, electromagnetic stirring, controlled solidification, strain activation, and powder metallurgy. These methods are disadvantageous for the following reasons: (1) the slurry preparation device is complex and costly; (2) the solid to liquid ratio in the semisolid slurry is difficult to control; (3) the solid content of the slurry is unstable; and (4) the cooling efficiency is relatively low. In addition, the processes are inefficient, and the semisolid slurry prepared by the processes includes coarse, large globular grains and low degree of roundness.

SUMMARY OF THE INVENTION

In view of the above-described problems, one objective of the disclosure is to provide a method and device for preparing semisolid slurry that feature efficient and stable cooling capacity.

To achieve the above objectives, in accordance with one embodiment of the invention, there is provided a method for preparing semisolid slurry, the method being achieved using a device for preparing semisolid slurry, the device comprising a slurry vessel and a mechanical stirring rod, the mechanical stirring rod comprising a first end and a second end extending into the slurry vessel, and the method comprising:

- S1: putting a molten alloy having a first preset temperature into the slurry vessel, wherein the first preset temperature is 30-120 degrees centigrade higher than a liquidus temperature of the molten alloy;
- S2: cooling the molten alloy to a second preset temperature, positioning the second end of the mechanical stirring rod to be 5-25 mm higher than a bottom wall of the slurry vessel, rotating the mechanical stirring rod at 100-900 rpm and injecting a cooling medium having a temperature of between −10 and 100 degrees centigrade into the mechanical stirring rod at a flow rate of 5-25 L/minute; wherein the second preset temperature is 20-60 degrees centigrade higher than the liquidus temperature of the molten alloy; and
- S3: allowing a temperature of the molten alloy to be 10-90 degrees centigrade lower than the liquidus temperature of the molten alloy, stopping stirring and cooling, to yield a semisolid slurry.

In a class of this embodiment, in S2, when the temperature of the molten alloy is 20-60 degrees centigrade higher than the liquidus temperature of the molten alloy, a stirring speed of the mechanical stirring rod is 100-400 rpm, the temperature of the cooling medium is between −10 and 50 degrees centigrade, and the flow rate of the cooling medium is 10-25 L/minute; when the temperature of the molten alloy is 0-10 degrees centigrade lower than the liquidus temperature of the molten alloy, the stirring speed of the mechanical stirring rod is 400-900 rpm, the temperature of the cooling medium is 20-80 degrees centigrade, and the flow rate of the cooling medium is 5-15 L/minute.

In a class of this embodiment, in S1, the first preset temperature of the molten alloy is 75 degrees centigrade higher than the liquidus temperature of the molten alloy; in S2, when the temperature of the molten alloy is 40 degrees centigrade higher than the liquidus temperature of the molten alloy, the second end of the mechanical stirring rod is positioned to be 15 mm higher than a bottom wall of the slurry vessel, the stirring speed of the mechanical stirring rod is 250 rpm, the temperature of the cooling medium is 20 degrees centigrade, and the flow rate of the cooling medium is 18 L/minute; when the temperature of the molten alloy is 5 degrees centigrade lower than the liquidus temperature of the molten alloy, the stirring speed of the mechanical stirring rod is 650 rpm, the temperature of the cooling medium is 50 degrees centigrade, and the flow rate of the cooling medium is 10 L/minute; and in S3, when the temperature of the semisolid slurry is 50 degrees centigrade lower than the liquidus temperature of the molten alloy, stopping stirring and cooling, to yield the semisolid slurry.

In a class of this embodiment, the alloy comprises aluminum alloy, magnesium alloy, copper alloy or zinc alloy.

In a class of this embodiment, the cooling medium is water, heat conduction oil or liquid organic solvent.

In another aspect, the disclosure provides a device for preparing semisolid slurry, the device comprising: a slurry vessel, a mechanical stirring rod, a plurality of stirring blades, a cooling medium controller, a cooling medium inlet pipe, and a cooling medium recycling pipe. The mechanical stirring rod is a hollow structure comprising a first end and a second end; the second end extends into the slurry vessel; the plurality of stirring blades is inserted in the hollow structure, and a vertical interval between the plurality of stirring blades and the second end of the mechanical stirring rod is 35-50 mm; and a first end of the cooling medium inlet pipe and a first end of the cooling medium recycling pipe are connected to the cooling medium controller, and a second end of the cooling medium inlet pipe and a second end of the cooling medium recycling pipe extend into the mechanical stirring rod.

According to the method for preparing semisolid slurry in the disclosure, the cooling medium is injected into the mechanical stirring rod, and the slurry is stirred and cooled by the mechanical stirring rod. In S1, the temperature of molten alloy is 30-120 degrees centigrade higher than the liquidus temperature of the molten alloy, the temperature of the molten alloy will be further decreased when putting the molten alloy into the slurry vessel, the temperature of the molten alloy in this state is affect by the heat exchanging between the molten alloy and the slurry vessel, and the temperature range of the molten alloy after the heat exchanging comprises the temperature range of molten alloy being treated by the subsequent procedures; in S2, the temperature is set to 20-60 degrees centigrade higher than the liquidus temperature of the molten alloy when stirring begins, the mechanical stirring rod is inserted at this time and the slurry is stirred and cooled. The insertion of the mechanical stirring rod has a role of chilling function on the slurry, and the temperature range of 20-60 degrees centigrade higher than the liquidus temperature of the molten alloy has certain buffer function, therefore when the slurry will form dendrite structure, the energy field and the temperature field in the slurry vessel are even. Mechanical stirring can break the primary solid phase, the stirring speed of the mechanical stirring rod is 100-900 rpm, this stirring speed can maintain the stirring function in the slurry and break the dendrite structure, and will not cause slurry splash and serious air entrapment. The cooling medium is injected into the slurry when stirring the slurry, the temperature of the cooling medium is −10-100 degrees centigrade, the flow rate of the injected cooling medium is 5-25 L/minute, and the temperature difference between the cooling medium and the molten alloy is large, therefore the heat can be exchanged rapidly. Finally, the terminal temperature for slurry preparation is set to the temperature of 10-90 degrees centigrade lower than the liquidus temperature of the molten alloy, at this temperature, the alloy slurry has higher semisolid content.

The depth of the mechanical stirring rod inserted in the slurry vessel is decided by two factors: cooling function and stirring function. The closer the second end of the mechanical stirring rod to the bottom of the slurry vessel, the bigger the heat transferring area between the slurry and the mechanical stirring rod. Considering the relative position of the stirring blades and the second end the mechanical stirring rod, the second end of the mechanical stirring rod extends to the position of 5-25 mm from the bottom of the slurry vessel, and at this position, good heat exchanging effect and even and sufficient stirring can be obtained.

S2 comprises two stages, step S21 and step S22:

In S21, when the temperature of the molten alloy is 20-60 degrees centigrade higher than the liquidus temperature of the molten alloy, the stirring speed of the mechanical stirring rod is 100-400 rpm, the temperature of the cooling medium is −10-50 degrees centigrade, and the flow rate of the cooling medium is 10-25 L/minute;

In S22, when the temperature of the slurry is 0-10 degrees centigrade lower than the liquidus temperature of the molten alloy, the stirring speed of the mechanical stirring rod is 400-900 rpm, the temperature of the cooling medium is 20-80 degrees centigrade, and the flow rate of the cooling medium is 5-15 L/minute;

In S21, during stirring and cooling procedure, the molten slurry is transformed to the semisolid slurry. In this procedure, cooling is a main function, and stirring is an auxiliary function, and the temperature of the slurry can be evenly decreased to the liquidus temperature of the molten alloy during a short time period, so that the slurry preparation efficiency can be improved. Therefore, the temperature of the cooling medium is set to −10-50 degrees centigrade, and the flow rate is set to 10-25 L/minute, to enhance the cooling effect. The cooling medium exchanges heat with the slurry through the stirring effect of the stirring blades. To maintain even temperature of the whole slurry, the stirring speed should be larger than 100 rpm, and to guarantee the sufficient contact of the stirring blade member and the slurry, the stirring speed should be no more than 400 rpm.

In S22, during stirring and cooling procedure, when the temperature of the slurry is 0-10 degrees centigrade lower than the liquidus temperature of the molten alloy, there are some primary solid phase in the slurry, and at this phase the main function is stirring, the auxiliary function is cooling. The temperature of the cooling medium should not be too low, because too low temperature will cause much coarse primary crystal phase structure, larger slurry viscosity and poor slurry mobility. Therefore, the temperature of the cooling medium is set to 20-80 degrees centigrade, and the flow rate of the cooling medium is set to 5-15 L/minute. On the other hand, for the slurry with larger viscosity, the stirring function should be increased, so that more refined and rounding globular grains structure can be produced from the slurry. In this procedure, the stirring speed should be 400-900 rpm, since rapid stirring speed may cause the problems such as slurry splash and serious air entrapment.

The efficiency of slurry preparation is higher, and the quality of the slurry is good, by combining stirring and cooling.

The method of the disclosure can be used for semisolid alloy slurry production, such as aluminum alloy, magnesium alloy, copper alloy and zinc alloy. Before preparing slurry, get certain alloy and measure its DSC curve, that is, Differential Scanning Calorimeter curve, to measuring the feature points in the phase change process and deciding the solidus temperature and the liquidus temperature of the molten alloy. The method for slurry preparation in the disclosure corresponds to the phase change process of the alloy. It is proved by many test that, the method is suitable for different alloy, especially for the above four alloys.

The cooling medium comprises water, heat conduction oil or liquid organic solvent, the cooling medium is chosen according to the declined range of the temperature during slurry preparation process. It should be noted that, any cooling medium that can be used for the method and realize the effect of decreasing slurry temperature is in the protect scope of the disclosure.

According to another aspect of the disclosure, the disclosure provides a device used for the method for preparing semisolid slurry. The device comprises a slurry vessel, a mechanical stirring rod, a plurality of stirring blades, a cooling medium controller, a cooling medium inlet pipe, a cooling medium recycling pipe; the mechanical stirring rod is a hollow structure which comprising a first end and a second end, the second end is inserted into the slurry in stirring state, the plurality of stirring blades are inserted into the hollow structure of the mechanical stirring rod, and a vertical interval h1 between the plurality of stirring blades and the second end of the mechanical stirring rod is 35-50 mm; a first end of the cooling medium inlet pipe and a first end of the cooling medium recycling pipe are connected to the cooling medium controller respectively, and a second end of the cooling medium inlet pipe and a second end of the cooling medium recycling pipe extend into the mechanical stirring rod.

By using the above structure, the device has the following benefits compared with the prior art: the device of the disclosure comprises a set of mechanical stirring apparatus, in which the mechanical stirring rod is provided with a plurality of stirring blades, the mechanical stirring rod is a hollow structure, the plurality of stirring blades are inserted into the hollow structure of the mechanical stirring rod, one ends of the stirring blades contact with the cooling medium in the mechanical stirring rod, another ends of the stirring blades are inserted into the slurry to stir. By using this structure design, the stirring blades play a role of heat conductor between the cooling medium and the slurry, and exchange heat with the slurry when breaking the dendrite. For the height, the vertical interval h1 between the plurality of stirring blades and the second end of the mechanical stirring rod is 35-50 mm, the vertical interval is the vertical distance between the lowest point of the stirring blade member in the vertical direction and the horizontal plane containing the second end of the mechanical stirring rod. By this distance, the stirring effect can concentrate on the central section and bottom of the slurry vessel, and the dendrite of the molten alloy can be broken completely, and the convection intensity can be increased, so that the temperature field and the concentration field in the undercooling alloy slurry can be even and uniform.

Furthermore, the mechanical stirring rod is a hollow structure, and the cooling medium inlet pipe and the cooling medium recycling pipe can be inserted in it. The cooling medium controller connects with the cooling medium inlet pipe and the cooling medium recycling pipe respectively, the distance between the second end of the cooling medium inlet pipe and the second end of the mechanical stirring rod is 10-20 mm, the distance between the second end of the cooling medium inlet pipe and the second end of the mechanical stirring rod is 300-350 mm. This distance is decided according to the cooling effect and liquid discharging. This distance should guarantee the cooling medium has enough staying time and can be discharged from the cooling medium recycling pipe successfully. To avoid the cooling medium in the mechanical stirring rod entering into the slurry, the first end of the mechanical stirring rod is specifically connected.

Furthermore, the mechanical stirring rod is provided with a coating agent, the coated agent coating comprises grease, filler or oil, specifically, mixture of heat resistant grease, filler or oil, having the functions of heat resistant and corrosion resistance of alloy liquid, to decrease the occurrence of accidents.

Furthermore, the stirring blades is H13 heat resisting die steel with its surface being nitrided. This material can not only realize good heat conduction effect, but also prevent the corrosion of alloy liquid and extend the service life of the device. It should be noted that, the stirring blades is not restricted to the above material, any material that can realize good heat conduction effect and prevent the corrosion of alloy liquid is within the protect scope of the disclosure.

Furthermore, the above device for preparing semisolid slurry comprises the first temperature measuring equipment and the second temperature measuring equipment, the first temperature measuring equipment is disposed in the slurry vessel, to monitor the temperature of the slurry in real time, and control the slurry preparation procedure. The second temperature measuring equipment is disposed on the cooling medium inlet pipe, for monitoring the temperature of the output cooling medium, to facilitate slurry preparation.

The mechanical stirring rod is vertically inserted into the slurry vessel along the central axis of the slurry vessel, the mechanical stirring rod is located in the central position of the slurry vessel, guaranteeing that the mechanical effect and the heat exchanging effect are transmitted from the central position of the slurry vessel to the outside, and the slurry has even and uniform globular grains. On the other hand, the insertion depth of the mechanical stirring rod is decided according to the specific slurry preparation process, and the position of the mechanical stirring rod is adjustable, guaranteeing the best stirring effect and cooling effect.

The examples of the disclosure are described with reference to the figures, and the other features and benefits will be clear.

DETAILED DESCRIPTION OF THE EMBODIMENTS

Figure 1:
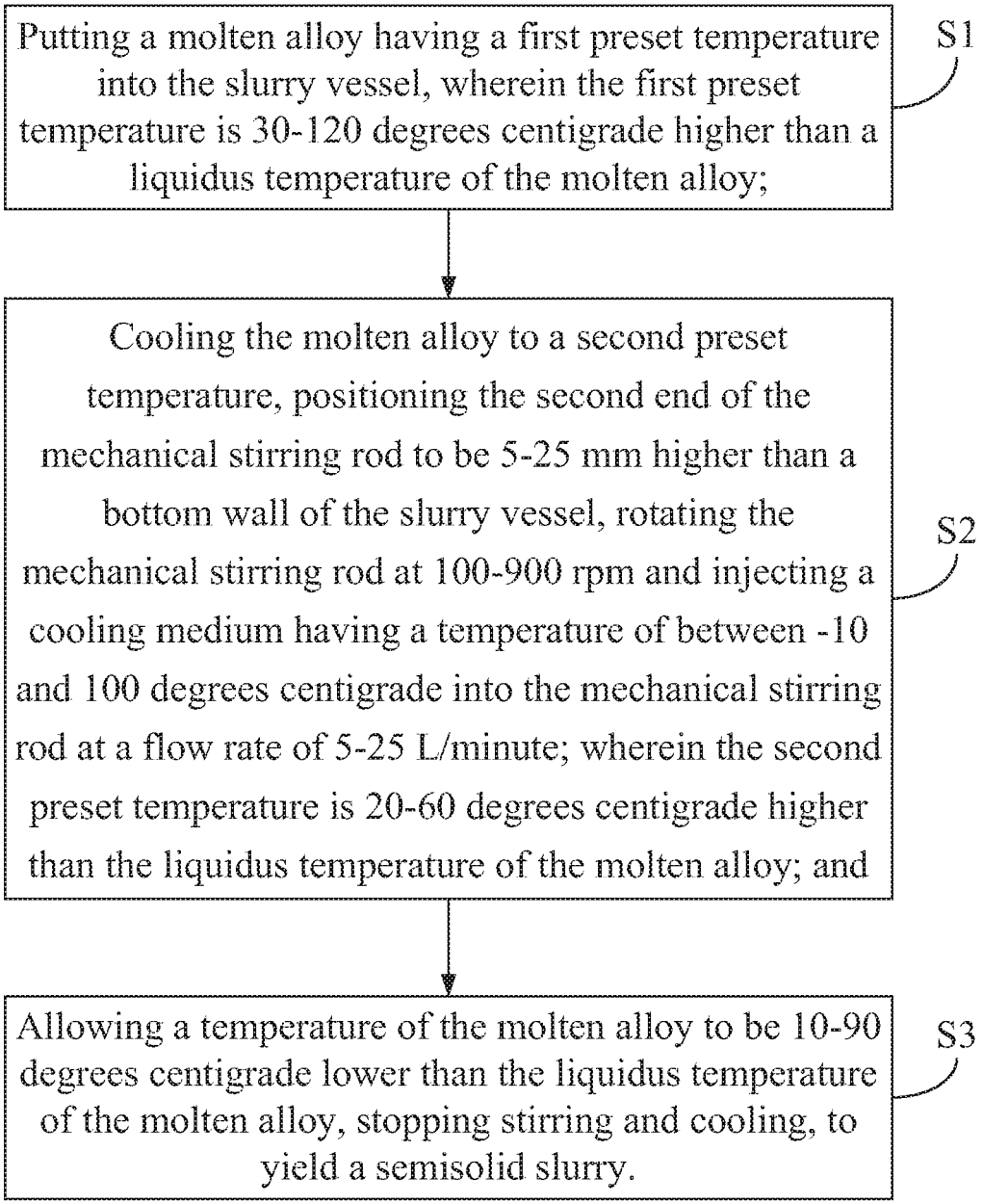
FIG. 1 is a flow diagram of a method for preparing semisolid slurry of one embodiment of the disclosure.

The method for preparing semisolid slurry in the disclosure comprises the following steps:

Step S1, putting a molten alloy having a first preset temperature into a slurry vessel, wherein the first preset temperature being 30-120 degrees centigrade higher than the liquidus temperature of the molten alloy;

Step S2, when a temperature of the molten alloy being decreased to a second preset temperature, adjusting the location of a mechanical stirring rod, extending a second end of the mechanical stirring rod to a position of 5-25 mm from the bottom of the slurry vessel, rotating the mechanical stirring rod, a stirring speed of the mechanical stirring rod being 100-900 rpm, the second preset temperature being 20-60 degrees centigrade higher than the liquidus temperature of the molten alloy;

meantime, cooling medium is injected into the mechanical stirring rod with a first preset flow rate, a temperature of the cooling medium being −10-100 degrees centigrade, and the first preset flow rate being 5-25 L/minute;

Step S3, when a temperature of the semisolid slurry being 10-90 degrees centigrade lower than the liquidus temperature of the molten alloy, stopping stirring and cooling to yield semisolid slurry.

Step S2 comprises step S21 and step S22, which are:

Step S21, when the temperature of the molten alloy being 20-60 degrees centigrade higher than the liquidus temperature of the molten alloy, the stirring speed of the mechanical stirring rod being 100-400 rpm, the temperature of the cooling medium being −10-50 degrees centigrade, and a flow rate of the cooling medium being 10-25 L/minute;

Step S22, when the temperature of the slurry being 0-10 degrees centigrade lower than the liquidus temperature of the molten alloy, the stirring speed of the mechanical stirring rod being 400-900 rpm, the temperature of the cooling medium being 20-80 degrees centigrade, and a flow rate of the cooling medium being 5-15 L/minute.

The steps of the slurry preparation method will be described in detail by means of examples.

Example 1

Step 101, putting molten aluminum alloy having a first preset temperature into a slurry vessel, the first preset temperature being 30 degrees centigrade higher than the liquidus temperature of the molten alloy;

Step 102, when a temperature of the molten aluminum alloy being decreased to a second preset temperature, adjusting the location of a mechanical stirring rod, extending a second end of the mechanical stirring rod to the position of 5 mm from the bottom of the slurry vessel, rotating the mechanical stirring rod, a stirring speed of the mechanical stirring rod being 500 rpm, the second preset temperature being 20 degrees centigrade higher than the liquidus temperature of the aluminum alloy;

meantime, cooling medium is injected into the mechanical stirring rod with a first preset flow rate, a temperature of the cooling medium being 100 degrees centigrade, and the first preset flow rate being 25 L/minute;

Step 103, when a temperature of the semisolid slurry being 10 degrees centigrade lower than the liquidus temperature of the aluminum alloy, stopping stirring and cooling to yield aluminum alloy semisolid slurry.

Example 2

Step 201, putting molten magnesium alloy having a first preset temperature into a slurry vessel, the first preset temperature being 70 degrees centigrade higher than the liquidus temperature of the molten alloy;

Step 2021, when a temperature of the molten magnesium alloy being 40 degrees centigrade higher than the liquidus temperature of the magnesium alloy, adjusting the location of a mechanical stirring rod, extending a second end of the mechanical stirring rod to the position of 25 mm from the bottom of the slurry vessel, rotating the mechanical stirring rod, the stirring speed of the mechanical stirring rod being 100 rpm, the temperature of the cooling medium being −10 degrees centigrade, and the flow rate of the cooling medium being 10 L/minute;

Step 2022, when a temperature of the slurry being 10 degrees centigrade lower than the liquidus temperature of the magnesium alloy, the stirring speed of the mechanical stirring rod being 400 rpm, the temperature of the cooling medium being 20 degrees centigrade, and the flow rate of the cooling medium being 5 L/minute;

Step 203, when a temperature of the magnesium alloy semisolid slurry being 90 degrees centigrade lower than the liquidus temperature of the molten alloy, stopping stirring and cooling to yield magnesium alloy semisolid slurry.

Example 3

Step 301, putting molten zinc alloy having a first preset temperature into a slurry vessel, the first preset temperature being 75 degrees centigrade higher than the liquidus temperature of the zinc alloy;

Step 3021, when a temperature of the molten zinc alloy being 40 degrees centigrade higher than the liquidus temperature of the molten alloy, adjusting the location of a mechanical stirring rod, extending a second end of the mechanical stirring rod to the position of 15 mm from the bottom of the slurry vessel, rotating the mechanical stirring rod, the stirring speed of the mechanical stirring rod being 250 rpm, the temperature of the cooling medium being 20 degrees centigrade, and the flow rate of the cooling medium being 18 L/minute;

Step 3022, when a temperature of the slurry being 5 degrees centigrade lower than the liquidus temperature of the zinc alloy, the stirring speed of the mechanical stirring rod being 650 rpm, the temperature of the cooling medium being 50 degrees centigrade, and the flow rate of the cooling medium being 10 L/minute;

Step 303, when a temperature of the zinc alloy semisolid slurry being 50 degrees centigrade lower than the liquidus temperature of the zinc alloy, stopping stirring and cooling to yield alloy semisolid slurry.

Example 4

Step 401, putting molten copper alloy having a first preset temperature into a slurry vessel, the first preset temperature being 120 degrees centigrade higher than the liquidus temperature of the molten alloy;

Step 4021, when a temperature of the molten copper alloy being 60 degrees centigrade higher than the liquidus temperature of the copper alloy, adjusting the location of a mechanical stirring rod, extending a second end of the mechanical stirring rod to the position of 10 mm from the bottom of the slurry vessel, rotating the mechanical stirring rod, the stirring speed of the mechanical stirring rod being 400 rpm, the temperature of the cooling medium being 50 degrees centigrade, and the flow rate of the cooling medium being 25 L/minute;

Step 4022, when a temperature of the slurry being decreased to the liquidus temperature of the copper alloy, the stirring speed of the mechanical stirring rod being 900 rpm, the temperature of the cooling medium being 80 degrees centigrade, and the flow rate of the cooling medium being 15 L/minute;

Step 403, when a temperature of the copper alloy semisolid slurry being 40 degrees centigrade lower than the liquidus temperature of the molten alloy, stopping stirring and cooling to yield copper alloy semisolid slurry.

The device for preparing semisolid slurry will be described below.

Figure 2:
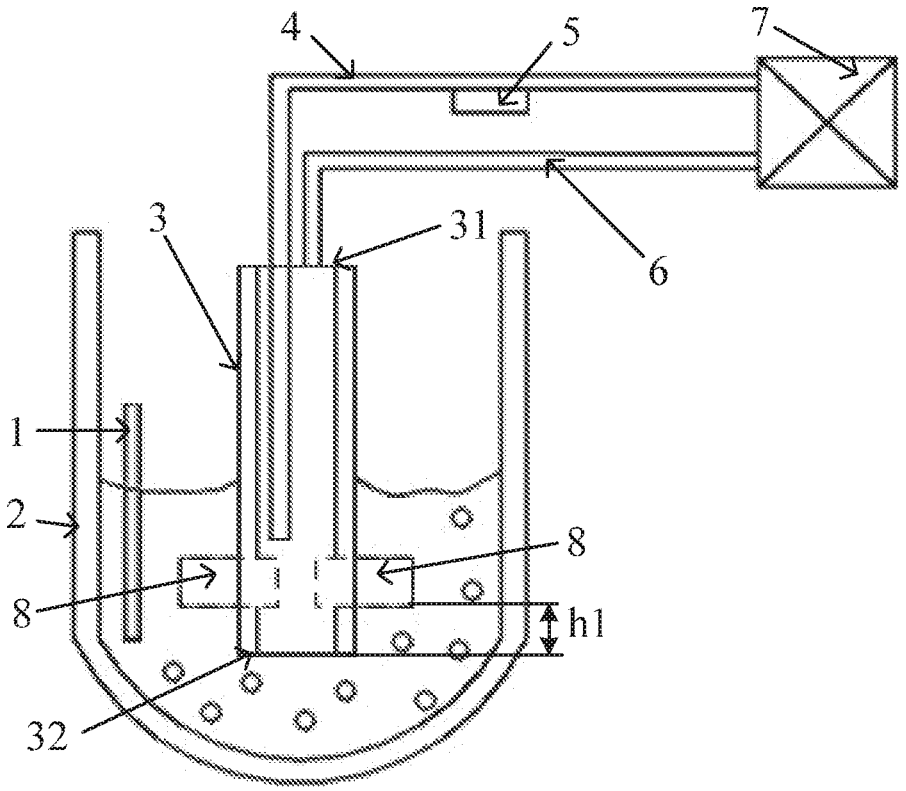
FIG. 2 is a schematic diagram of a device for preparing semisolid slurry of one embodiment of the disclosure.

As shown in FIG. 2, according to the schematic diagram of an example in working state, the device for preparing semisolid slurry comprises: a slurry vessel 2, a mechanical stirring rod 3, two stirring blades 8, a cooling medium controller 7, a cooling medium inlet pipe 4, a cooling medium recycling pipe 6, a first temperature measuring equipment 1 and a second temperature measuring equipment 5, the first temperature measuring equipment 1 is disposed in the slurry vessel 2, the second temperature measuring equipment 5 is disposed on the cooling medium inlet pipe 4, the mechanical stirring rod 3 is a hollow structure which comprising a first end 31 and a second end 32, the second end 32 is inserted into the slurry in stirring state, the two stirring blades 8 are inserted into the hollow structure of the mechanical stirring rod, and the vertical interval h1 between the stirring blades 8 and the second end 32 of the mechanical stirring rod is 42 mm; a first end of the cooling medium inlet pipe 4 and a first end of the cooling medium recycling pipe 6 are connected to the cooling medium controller 7 respectively, and a second end of the cooling medium inlet pipe 4 and a second end of the cooling medium recycling pipe 6 extend into the mechanical stirring rod.

The distance between the second end of the cooling medium inlet pipe and the second end of the mechanical stirring rod is 15 mm, the distance between the second end of the cooling medium inlet pipe and the second end of the mechanical stirring rod is 325 mm.

The mechanical stirring rod is provided with a coating agent, the stirring blades is H13 heat resisting die steel with its surface being nitrided.

Furthermore, the mechanical stirring rod 3 is vertically inserted into the slurry vessel 2 along the central axis of the slurry vessel 2, the distance between the second end 32 of the mechanical stirring rod 3 and the bottom of the slurry vessel 2 can be adjusted along the central axis.

Specially, the number of the stirring blade numbers is three, the vertical interval h1 is 50 mm, the distance between the second end of the cooling medium inlet pipe and the second end of the mechanical stirring rod is 10 mm, the distance between the second end of the cooling medium recycling pipe and the second end of the mechanical stirring rod is 300 mm.

The number of the stirring blade numbers may be four or above four, the vertical interval h1 is 35 mm, the distance between the second end of the cooling medium inlet pipe and the second end of the mechanical stirring rod is 20 mm, the distance between the second end of the cooling medium recycling pipe and the second end of the mechanical stirring rod is 350 mm.

Test Example 1

The aluminum alloy semisolid slurry is produced by using the methods and devices in the above examples. Its temperature is 600 degrees centigrade, and solid content is 42%. The aluminum alloy semisolid slurry is die casted to yield die casting products. The morphology of the metallographic structure of the die casting products is good, and the shape factor of the globular grains is 0.88.

Test Example 2

The magnesium alloy semisolid slurry is produced by using the methods and devices in the above examples. Its temperature is 495 degrees centigrade, and solid content is 45%. The aluminum alloy semisolid slurry is die casted to yield die casting products. The morphology of the metallographic structure of the die casting products is good, and the shape factor of the globular grains is 0.78.

Test Example 3

The aluminum zinc semisolid slurry is produced by using the methods and devices in the above examples. Its temperature is 390 degrees centigrade, and solid content is 52%. The aluminum alloy semisolid slurry is die casted to yield die casting products. The morphology of the metallographic structure of the die casting products is good, and the shape factor of the globular grains is 0.82.

Test Example 4

The aluminum copper semisolid slurry is produced by using the methods and devices in the above examples. Its temperature is 860 degrees centigrade, and solid content is 56%. The aluminum alloy semisolid slurry is die casted to yield die casting products. The morphology of the metallographic structure of the die casting products is good, and the shape factor of the globular grains is 0.75.

It can be seen from the above test examples that the method and device for preparing semisolid slurry in the disclosure have the benefits of high slurry preparation efficiency, high quality of the semisolid slurry, wide range of alloy application. Specifically, the benefits are:

(1) high slurry preparation efficiency, high quality of the semisolid slurry: the stirring blades are inserted into the hollow structure of the mechanical stirring rod, the cooling medium exchanges heat with the slurry through the stirring apparatus, stirring and cooling are realized at the same time, and the controlling of the stirring and cooling procedures is combined with alloy phase diagram, to yield the semisolid slurry with high roundness of globular grains and high solid content.

(2) wide range of alloy application: the operation of slurry preparation is combined with alloy phase diagram, the temperature, flow rate of the cooling medium and the mechanical stirring speed, etc. are controlled. The method and device provided in the disclosure can be applied for preparing semisolid slurry of multiple alloys, such as aluminum alloy, magnesium alloy, zinc alloy or cooper alloy.

The above examples can be implemented individually and can be combined in various ways, all these variants are in the protection scope of the disclosure.

The method and device of preparing the semisolid slurry combine the cooling apparatus and the stirring apparatus to yield high slurry preparation efficiency. The temperature, flow rate of the cooling medium and the mechanical stirring speed are controlled to yield the semisolid slurry with high quality. Also, the method and device have wide range of alloy application, can solve the problems of unstable solid content of slurry and low preparation efficiency, therefore, is suitable for semisolid die casting production.

Unless otherwise indicated, the numerical ranges involved in the invention include the end values. While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

The invention claimed is:

1. A method for preparing semisolid slurry comprising:

placing a molten alloy having a first preset temperature into a slurry vessel, the first preset temperature being 30-120 degrees centigrade higher than a liquidus temperature of the molten alloy;

in response to the molten alloy having been cooled to a second preset temperature that is lower than the first preset temperature and 20-60 degrees centigrade higher than the liquidus temperature of the molten alloy, starting to perform a stirring process on the molten alloy, the stirring process including:

stirring the molten alloy using a mechanical stirring rod containing a cooling medium under a first condition, until the molten alloy is cooled to a third preset temperature that is lower than the second preset temperature and 0-10 degrees centigrade lower than the liquidus temperature of the molten alloy, the first condition including:

a stirring speed of the mechanical stirring rod being a first stirring speed that is in a range from 100 to 400 rpm, and a temperature of the cooling medium being a first medium temperature that is in a range from −10 to 48 degrees centigrade; and continuing to stir the molten alloy using the mechanical stirring rod containing the cooling medium under a second condition, until the molten alloy is cooled to a fourth preset temperature that is lower than the third preset temperature and 10-90 degrees centigrade lower than the liquidus temperature of the molten alloy, the second condition including:

the stirring speed of the mechanical stirring rod being a second stirring speed that is in a range from 410 to 900 rpm, and the temperature of the cooling medium being a second medium temperature that is in a range from 50 to 80 degrees centigrade; and in response to the molten alloy having been cooled to the fourth preset temperature, stopping stirring and cooling to obtain the semisolid slurry.

2. The method of claim 1, wherein:

the first preset temperature is 75 degrees centigrade higher than the liquidus temperature of the molten alloy;

the second preset temperature is 40 degrees centigrade higher than the liquidus temperature of the molten alloy, the first stirring speed is 250 rpm, and the first medium temperature is 20 degrees centigrade;

the third preset temperature is 5 degrees centigrade lower than the liquidus temperature of the molten alloy, the second stirring speed is 650 rpm, and the second medium temperature is 50 degrees centigrade; and the fourth preset temperature is 50 degrees centigrade lower than the liquidus temperature of the molten alloy.

3. The method of claim 1, wherein the alloy includes at least one of aluminum alloy, magnesium alloy, copper alloy, or zinc alloy.

4. The method of claim 1, wherein the cooling medium includes at least one of water, heat conduction oil, or liquid organic solvent.

* * * * *